US005779043A

United States Patent [19]

Hsu et al.

[11] Patent Number: 5,779,043

[45] Date of Patent: Jul. 14, 1998

[54] GOLF CLUBS MOUNTING STRUCTURE

[75] Inventors: Sen-Jung Hsu, No. 27, Nong 26, Lane 2, Kuang-Fu St., Yeong-Ho City, Taipei Hsien, Taiwan; Te-Fu Hsu; Chi-Ern Hsu, both of Yeong-Ho, Japan

[73] Assignee: Sen-Jung Hsu, Yeong-Ho, Taiwan; a part interest

[21] Appl. No.: 778,790

[22] Filed: Jan. 6, 1997

[51] Int. Cl.[6] ..... A63B 55/00; A63B 57/00

[52] U.S. Cl. ..... 206/315.6; 206/315.2; 211/70.2

[58] Field of Search ..... 206/315.2, 315.3, 206/315.6; 211/70.2

[56] References Cited

U.S. PATENT DOCUMENTS

| | | | |
|---|---|---|---|
| 1,756,902 | 4/1930 | Boyce | 206/315.6 |
| 3,503,518 | 3/1970 | Black | 206/315.6 X |
| 5,617,951 | 4/1997 | Wick | 206/315.6 |
| 5,636,734 | 6/1997 | Smith | 206/315.6 X |

*Primary Examiner*—Sue A. Weaver

*Attorney, Agent, or Firm*—Bucknam and Archer

[57] ABSTRACT

An improved golf clubs mounting structure includes a mounting frame, a movable vertical arm, a movable auxiliary vertical arm and a plurality of jaw elements. The mounting frame has an adjusting seat at its bottoms side for coupling with the movable vertical arm, the distance between the movable vertical arm and the adjusting seat may be easily adjusted. The movable auxiliary vertical arm is joined to the mounting frame by an auxiliary arm support at a middle section of the bottom side of the mounting frame to give stability to the whole structure. The movable auxiliary vertical arm has a support arm provided with slots for engaging the jaw elements for holding additional golf clubs. The movable arm of the mounting frame, the movable vertical arm and the movable auxiliary vertical arm are respectively provided with a clamp portion at their bottom ends to facilitate clamping of the mounting structure to the golf bag. Each clamp portion includes an inverted V-shaped opening at the front, two clamping projections next to the opening, a clamp groove and a semi-circular positioning recess which may not damage the golf bag when the mounting structure is removed from the golf bag.

4 Claims, 6 Drawing Sheets

GOLF CLUBS MOUNTING STRUCTURE

BACKGROUND OF THE INVENTION (a). Field of the Invention

The present invention relates to an improved golf clubs mounting structure for golf bags.

(b). Description of the Prior Art

A complete set of clubs is indispensable to professional or amateur golfers. Clubs of different numbers in a set are all placed in a golf bag. The golf bag may be carried by the golfer, pushed in a cart or carried by a caddie. Wooden clubs, iron clubs and the sputter may all be used in a game. Therefore, even though there are many of them and they are quite heavy, they must all be carried in the golf bag throughout the game. A major problem of concern to most golfers is not the heaviness of the clubs but the convenience of taking out the clubs from the golf bag.

As mentioned above, all the clubs are placed in the golf bag. In the course of the game, the bag has to be left opened so that the golfer may pick out the required clubs. However, although there are provided various club pockets each contain clubs of the same category, there are still several clubs of the same category in each club pocket, which is inconvenient for the golfer to pick out the desired one. Besides, since the clubs vary in length, if the required club is shorter, the golfer has to dig his hand into the club pocket to look for it, which is very troublesome indeed.

In R.O.C. Publication No. 269197 (Application No. 84211479) published on Jan. 21, 1996, a golf clubs mounting frame is disclosed (see FIG. 1). It comprises a securing frame 10A of a planar inverted-U shape clamped to the opening of the golf bag. Screws 124A, 134A and corrugated teeth 122A, 132A work in cooperation to clamp the mounting frame to the bag. Width adjustment is achieved by locking a screw 128A into any one of a plurality of locking holes 127A which are spaced equidistantly apart from each other. There are however several disadvantages with this prior art.

1. As the inverted-U shaped mounting frame is clamped to the golf bag in a planar manner, the two-point positioning is not firm and may generate shaking.

2. The corrugated teeth 122A, 132A may easily damage the golf bag when the mounting frame is removed from the golf bag. Besides, if the screws 124A, 134A are too tightly locked, the clamping jaws 120A, 130A having the corrugated teeth 122A, 132A may easily stretch open, unable to achieve firm clamping.

3. The manner of width adjustment is not convenient.

4. The clamping elements 11A of the mounting frame each have a narrow opening 110A, which does not allow easy insertion of golf clubs. Besides since golf clubs vary in thickness, the clamping elements 11A cannot effectively secure the golf clubs.

SUMMARY OF THE INVENTION

Accordingly, a primary object of the present invention is to provide an improved golf clubs mounting frame structure which may be clamped firmly to golf bags of various sizes and which provides easy mounting of golf clubs and contains more clubs, thus eliminating the drawbacks with the prior art.

In order to accomplish the above-mentioned object, the improved mounting structure of the invention essentially comprises a mounting frame, a movable vertical arm, a movable auxiliary vertical arm and a plurality of jaw elements. A top side of the mounting frame is provide with a plurality of mounting seats for matching a plurality of slots engaging the jaw elements at one side to secure the golf clubs. An adjusting seat with a connecting hole extends from a bottom side of the mounting frame for connecting to an adjusting column of the movable vertical arm to allow adjustment of the distance between the movable vertical arm to the adjusting seat. An auxiliary arm support at a middle section of the bottom side of the mounting frame is provided with a through hole for receiving a support arm of the movable auxiliary vertical arm. The support arm has a couple of slots for engaging the jaw elements for holding additional golf clubs. The vertical arm of the mounting frame, the movable vertical arm, the movable auxiliary vertical arm all have a clamp portion. The clamp portion includes an inverted V-shaped opening at the front, two clamping projections adjacent to the opening, a clamp groove and a semi-circular positioning recess at the rear to facilitate clamping and prevent damaging the golf bag upon removal of the mounting structure therefrom.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
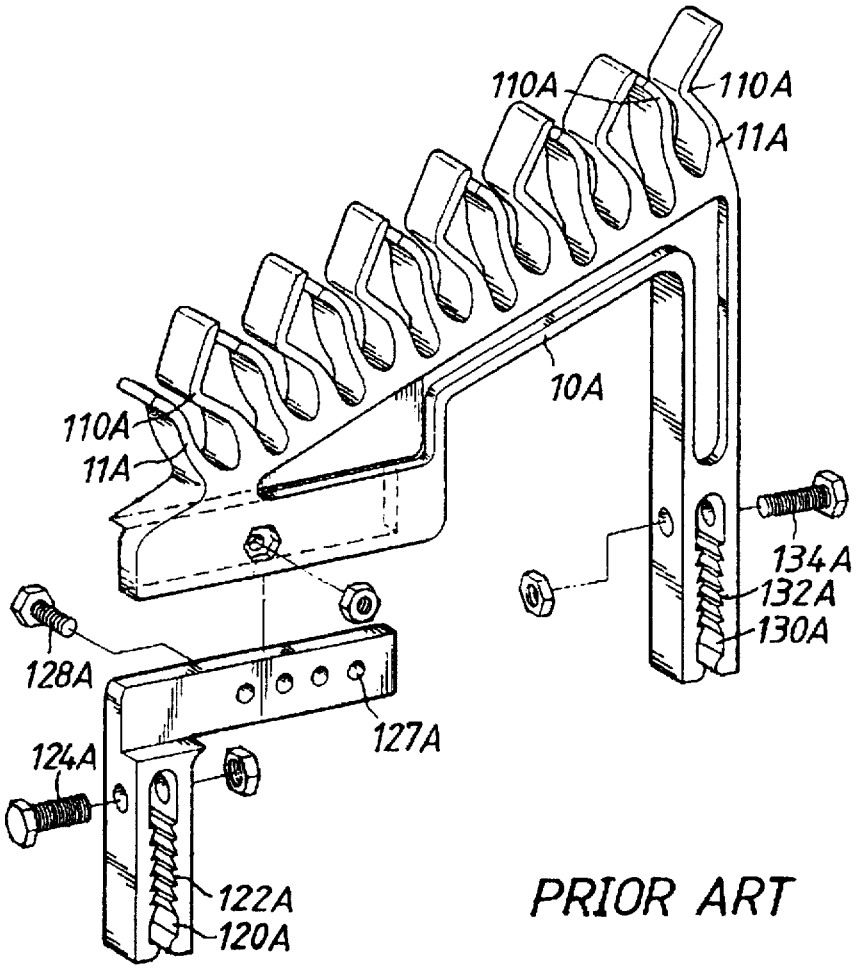
FIG. 1 is an elevational view of the prior art.
Figure 2:
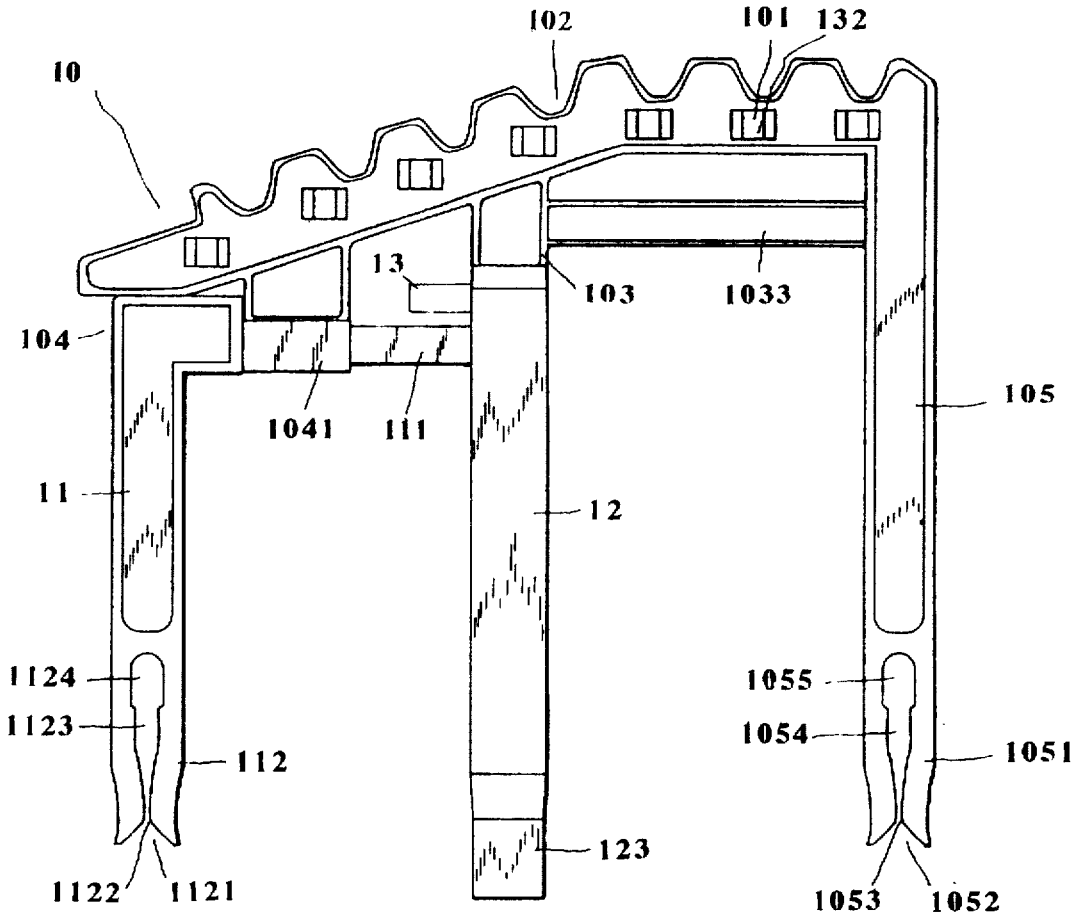
FIG. 2 is a front view of a preferred embodiment of the present invention.
Figure 3:
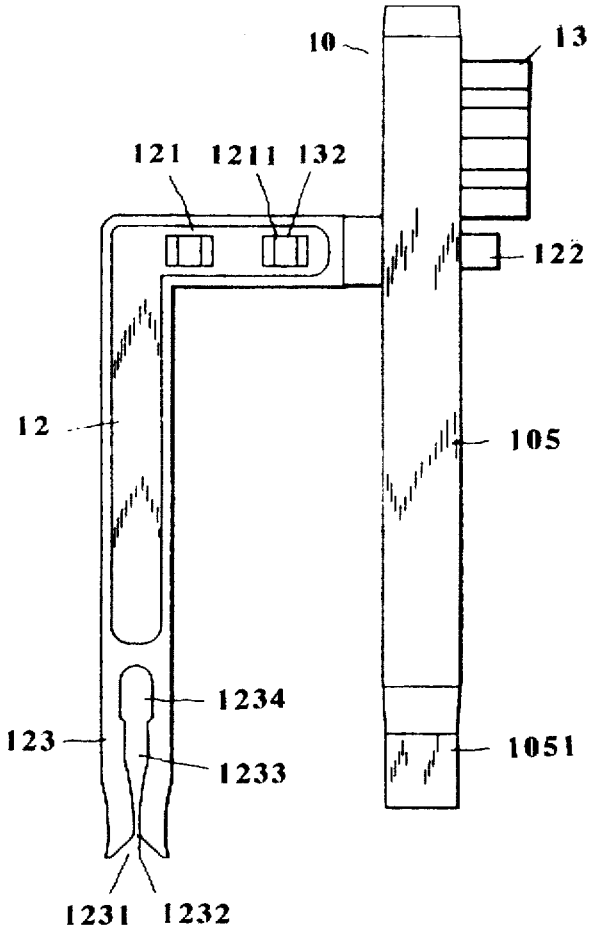
FIG. 3 is a side view of the preferred embodiment of the present invention.
Figure 4:
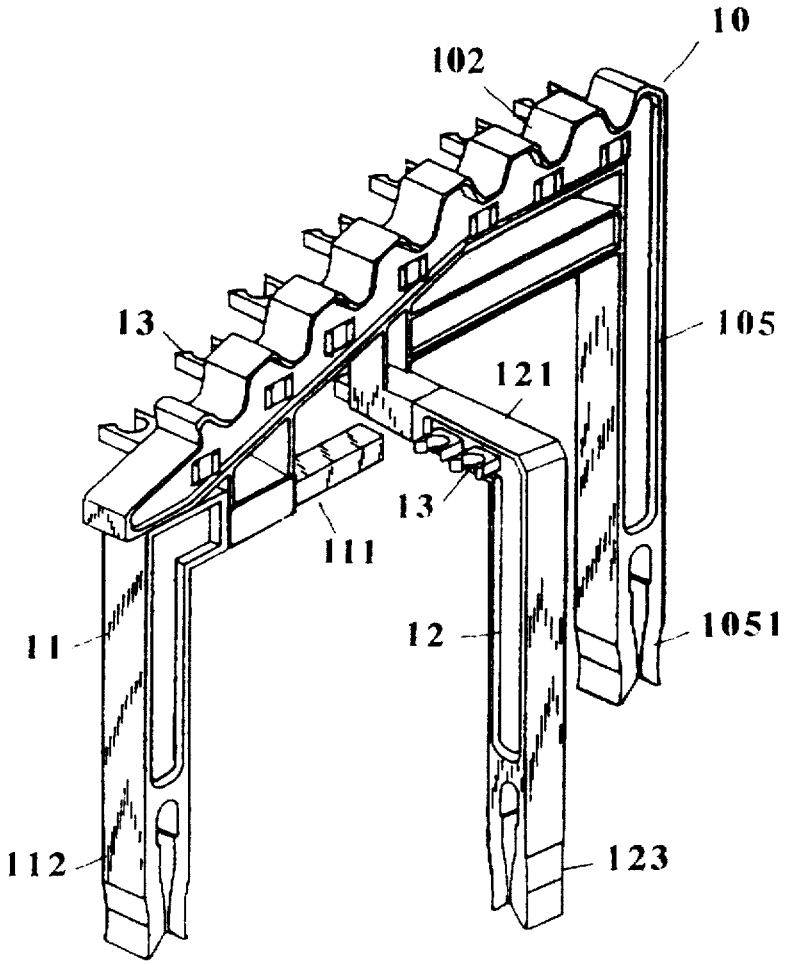
FIG. 4 is an elevational view of the preferred embodiment of the present invention.

With reference to FIGS. 2, 3 and 4, the improved mounting frame structure for golf clubs according to the present invention essentially comprises a mounting frame 10, a movable vertical arm 11, a movable auxiliary vertical arm 12 and a plurality of jaws elements 13.

The mounting frame 10 includes an upper portion having one inclined side. The sides of the mounting frame 10 are provided with a plurality of rectangular through slots 101 for engaging the jaws 13. A plurality of substantially V-shaped mounting seats 102 are correspondingly formed above the slots 101 such that when a neck 32 of a club 30 is clamped by the jaw element 13, its head 31 is mounted on the mounting seat 102 so that the clubs 30 may be effectively secured in place in a neat order. At approximately a middle section of the slanting portion of the mounting frame 10 is provided a downward, extending portion 103, which has an auxiliary arm support 1031 extending horizontally from one side thereof. The auxiliary arm support 1031 is provided with a through quadrilateral hole 1032 such that one side of the mounting frame 10 may be vertically connected to the movable auxiliary vertical arm 12. The downward, extending portion 103 has one side thereof connected to a vertical arm 105 at one end of the mounting frame 10 by an integral reinforcing support 1033 disposed therebetween so that the structure of the auxiliary arm support 1031 may be strengthened. A recessed seat 104 is disposed near the other end of the mounting frame 10 and has an adjusting seat 1041 provided with a quadrilateral connecting hole 1042. The above-mentioned vertical arm 105 integrally extends vertically from the mounting frame 10. A bottom end of the vertical arm 105 is provided with a clamp portion 1051 which orients vertically. The clamp portion 1051 has a front end forming a substantially inverted Vshaped opening 1052 to facilitate clipping of the vertical arm 105 to the rim of the golf bag. Two facing clamping projections 1053 capable of coming together extend from a rear side of the inverted V-shaped opening 1052. A clamp groove 1054 of a gradually increasing width is provided to the rear of the clamp projections 1053. A rear end of the clamp groove 1054 is configured to be a substantially larger semi-circular positioning recess 1055 so that the mounting frame 10 may be conveniently clamped to a side 21 of the golf bag.

The movable vertical arm 11 is substantially an inverted-L shape. An upper end thereof extends horizontally to form a quadrilateral, adjusting column 111 for insertion into the quadrilateral connecting hole 1042 of the adjusting seat 104 of the mounting frame 10. A bottom side of the movable vertical arm 11 is also provided with a clamp portion 112 similar to the clamp portion 1051 of the vertical arm 105. Likewise, the clamp portion 112 has a front end forming a substantially inverted V-shaped opening 1121 to facilitate clipping of the vertical arm onto the rim of the golf bag. Two facing clamping projections 1122 capable of coming together are provided along a rear side of the inverted V-shaped opening 1121. A clamp groove 1123 of a gradually increasing width is provided to the rear of the clamp projections 1122. A rear end of the clamp groove 1123 is configured to be a substantially larger semi-circular positioning recess 1024.

The movable auxiliary vertical arm 12 is provided to more firmly secure the mounting frame 10 in place and to enhance the mounting of the golf clubs. An upper end of the movable auxiliary vertical arm 12 extends horizontally to one side, forming a support arm 121, which has a front end forming a quadrilateral column 122 engaging the through quadrilateral hole 1032 of the auxiliary arm support 1031 of the mounting frame 10. The support arm 121 is provided with two rectangular slots 1211 spaced appropriately apart from each other at a side wall thereof for engaging two jaw elements 13. A bottom side of the movable auxiliary vertical arm 12 is likewise provided with a vertically oriented clamp portion 123 similar to the clamp portion 1051 of the vertical arm 105. The clamp portion 123 has a front end forming a substantially inverted V-shaped opening 1231 to facilitate clipping of the movable auxiliary vertical arm 12 to the rim of the golf bag. Two facing clamping projections 1232 capable of coming together extend along the rear side of the inverted V-shaped opening 1231. A clamp groove 1233 of a gradually increasing width is provided to the rear of the clamping projections 1232. A rear end of the clamp groove 1233 is configured to be a substantially larger semi-circular positioning recess 1234.

The above-mentioned jaw elements 13 each have a front end configured to be a circular opening 131 and a rear end provided with two hooks 132 to either side and spaced appropriately apart from each other. By pressing the two hooks 132, each jaw element 13 may engage the rectangular slot 101 of the mounting frame 10 or the rectangular slot 1211 of the movable auxiliary vertical arm 12.

Figure 5:
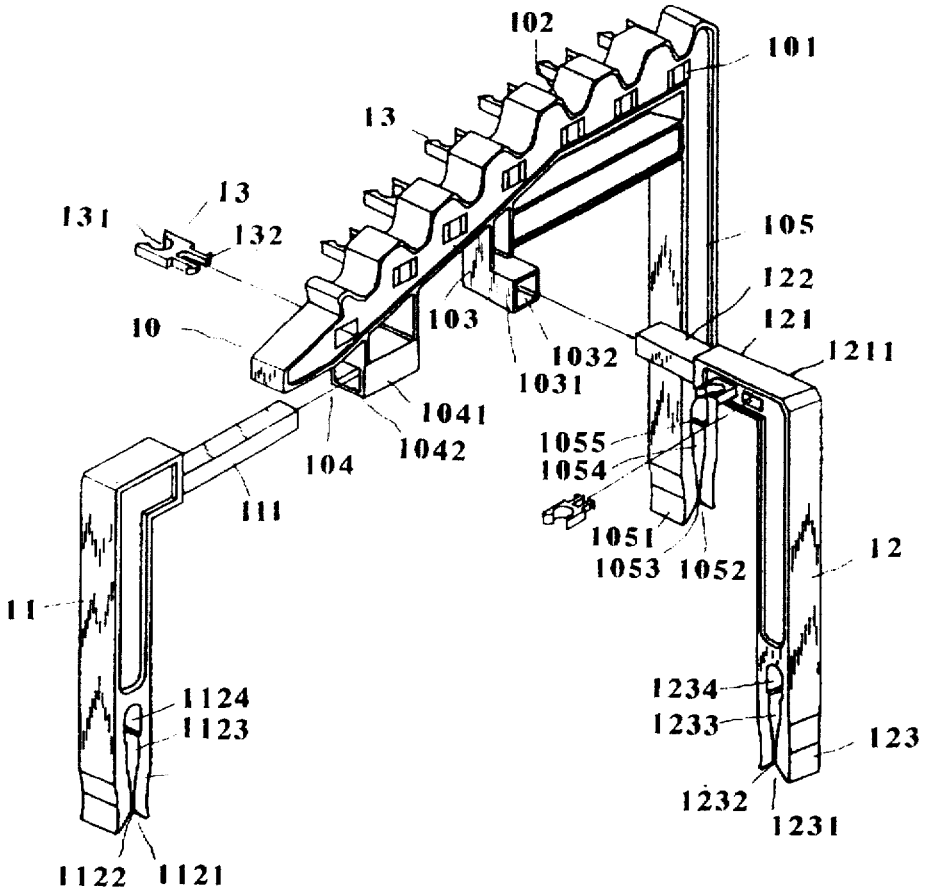
FIG. 5 is an exploded, elevational view of the preferred embodiment of the present invention.
Figure 6:
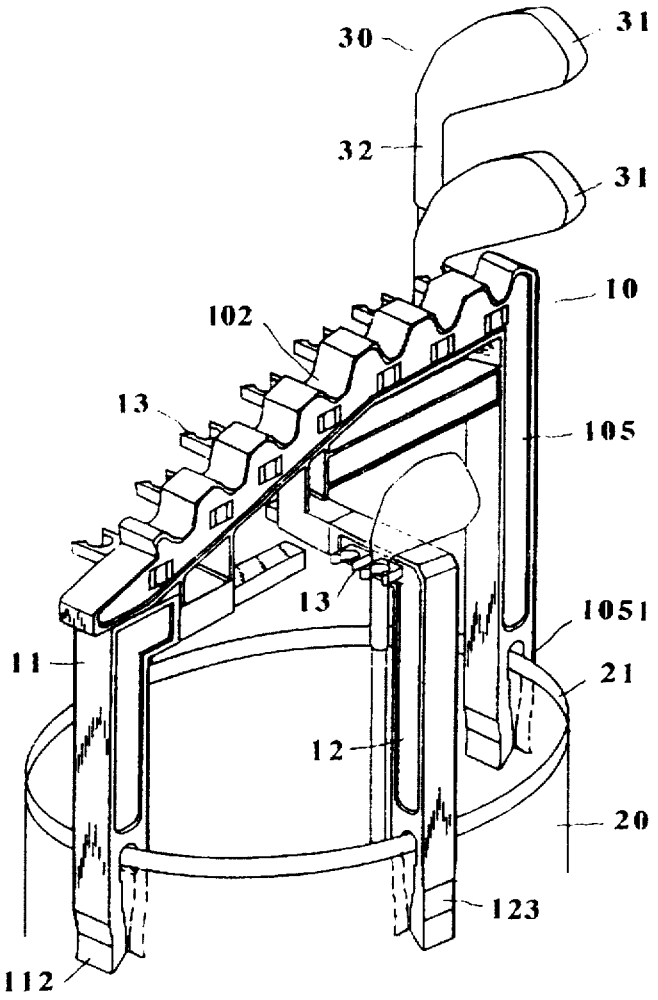
FIG. 6 is an elevational view showing the preferred embodiment of the present invention in use.

With reference to FIGS. 5 and 6, the movable vertical arm 11 and the movable auxiliary vertical arm 12 are assembled to the mounting frame 10 in a detachable manner. The width of the mounting frame structure of the invention may be adjusted with ease to match the size of the golf bag and mounted at the side 21 of the golf bag. The adjusting column 111 of the vertical arm 11 fitted into the quadrilateral connecting hole 1042 of the adjusting seat 1041 of the mounting frame 10 enables the movable arm 11 to be coupled with the mounting frame 10 as an integral structure to achieve firm mounting. In use, as the relative distance between the adjusting column 11 and the adjusting seat 1041 may be adjusted, the distance between the respective clamp portions of the movable vertical arm 11 and the vertical arm 15 may be adjusted to allow the mounting frame structure of the invention to suit golf bags of various sizes. Furthermore, the quadrilateral column 122 of the movable auxiliary vertical arm 12 is inserted into the quadrilateral through hole 1031 of the auxiliary arm support 103 at the bottom side of the mounting frame 10; the support arm 121 has an upper end provided with two clamp elements 13 for clamping more golf clubs 30. Since the vertical arm 105, the movable auxiliary vertical arm 12 and the movable vertical arm 11 have their respective clamp portions 1051, 112, and 123 clamping the rim of the golf bag at different points, the mounting frame structure of the invention is more firmly mounted onto the golf bag. Besides, the inverted V-shaped openings 1052, 112 and 123 allow easy clipping to the side 21 of the golf bag. Moreover, due to the configuration of the clamping projections 1053, 1122 and 1232 and the clamp grooves 1054, 1123 and 1233, after the respective clamp portions 1051, 112 and 123 are insertably clamped to the golf bag, the smooth walls of the recessed grooves 1055, 1124 and 1234 will not cause damage to the upper rim of the golf bag when the mounting structure is moved.

In view of the aforesaid, it can be seen that the present invention essentially comprises assembling the vertical arm 105, the movable vertical arm and movable auxiliary vertical arm 12 of the mounting frame 10 as an integral whole. The relative distances among the movable arm 11, the movable auxiliary vertical arm 12 and the vertical arm 105 may be easily adjusted to match various golf bag sizes. The three vertical arms mentioned above may be secured onto the rim of the golf bag by means of their respective clamp portions. After assembly, all the golf clubs 30 may be arranged on the mounting frame 10 and held be the jaw elements 13 on the mounting frame 10 and the movable auxiliary vertical arm 12.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved, golf clubs mounting structure, comprising a mounting frame, a movable vertical arm, a movable auxiliary vertical arm and a plurality of jaw elements:

said mounting frame having an upper portion which inclines to one side to form a slanting portion, a plurality of rectangular through slots in a side wall thereof for engaging said jaw elements, and a plurality of substantially V-shaped mounting seats disposed on an upper side thereof for matching said rectangular through slots; a downwardly extending portion extending from approximately a middle section of the bottom side of said slanting portion, said downwardly extending portion having one side extending horizontally to form an auxiliary arm support provided with a rectangular through hole, a reinforcing support being mounted between a side wall of said downwardly extending portion and a vertical arm to strength the structure of said auxiliary arm support; a recessed seat being disposed near the end of said slanting portion of said mounting frame, said recessed seat being provided with an adjusting seat having a quadrilateral connecting hole, said vertical arm extending integrally from the other end of said mounting frame and having a vertically oriented clamp portion provided,at a bottom end thereof;

said movable vertical arm having an upper end extending horizontally to one side to form a quadrilateral adjusting column which may fit into said quadrilateral connecting hole of said adjusting seat of said mounting frame, said movable vertical arm further having a clamp portion extending vertically from a bottom end thereof and matching said clamp portion of said vertical arm of said mounting frame;

said movable auxiliary vertical arm having an upper end extending horizontally to one side to form a support arm with a quadrilateral column at a front end thereof for fitting into the quadrilateral through hole of said auxiliary arm support of said mounting frame, said support arm having a side wall provided with two rectangular slots spaced suitably apart from each other for engaging two of said jaw elements; said movable auxiliary vertical arm further having a clamp portion extending vertically from a bottom end thereof and matching said clamp portion of said vertical arm of said mounting frame; and said jaw elements each having a front end forming a substantially circular opening and a rear end provided with two hooks which are spaced apart suitably from each other, said jaw elements being fitted into the respective rectangular slots of said mounting frame and said support arm by pressing said hooks, thereby:

said rectangular slots engaging said jaw elements each hold the neck of a golf club and said mounting seats located above said rectangular slots each hold the head of the golf club so that a complete set of golf clubs may be positioned effectively and arranged neatly on said mounting frame; said adjusting seat has said adjusting column of said movable vertical arm inserted therethrough such that the distance between said clamp portion of said movable vertical arm and said vertical arm of said mounting frame can be adjusted; and said auxiliary arm support is movably coupled to said movable auxiliary vertical arm to enhance the stability of said mounting frame.

2. An improved golf clubs mounting structure as claimed in claim 1, wherein said movable arm has said adjusting column movably inserted into said quadrilateral connecting hole of said adjusting seat so that said movable vertical arm and said mounting frame are integrally assembled to allow easy adjustment.

3. An improved golf clubs mounting structure as claimed in claim 1, wherein the respective clamp portions of said vertical arm of said mounting frame, said movable vertical arm and said movable auxiliary vertical arm each have a front end forming an inverted V-shaped opening to facilitate clamping onto the golf bag, two facing clamping projections provided to the rear of said opening, a clamp groove of a gradually increased width provided to the rear of said clamping projections, said clamp groove having a rear end forming a substantially larger semi-circular positioning recess which may not damage the golf bag upon removal of the mounting structure therefrom.

4. An improved golf clubs mounting structure as claimed in claim 1, wherein said quadrilateral column of said support arm of said movable auxiliary vertical arm is movably inserted into said quadrilateral through hole of said auxiliary arm support of said mounting frame to freely adjust the distance between said mounting frame and said clamp portion of said movable auxiliary vertical arm, and said rectangular slots on said support arm engage two of said jaw elements to hold additional golf clubs.

* * * * *